United States Patent [19]

Buslik

[11] 3,955,670

[45] May 11, 1976

[54] PRESERVATION OF PAINT BRUSH

[76] Inventor: David Buslik, 273 Outlook Ave., Youngstown, Ohio 44504

[22] Filed: May 14, 1975

[21] Appl. No.: 577,611

[52] U.S. Cl. ..... 206/15.3; 206/209

[51] Int. Cl.[2] ..... A45D 44/18; B65D 81/24

[58] Field of Search ..... 206/205, 209, 361, 362.3, 206/15.2, 15.3; 215/228; 220/90

[56] References Cited

UNITED STATES PATENTS

| | | | |
|---|---|---|---|
| 1,050,381 | 1/1913 | Oleson | 206/15.3 |
| 1,171,139 | 2/1916 | Roberts | 206/15.3 |
| 2,047,641 | 7/1936 | Mares | 206/209 |
| 2,782,909 | 2/1957 | McNamara | 206/15.3 |
| 3,291,295 | 12/1966 | Caligiuri | 206/15.3 |

*Primary Examiner*—Steven E. Lipman
*Attorney, Agent, or Firm*—Hymen Diamond

[57] ABSTRACT

A paint brush holder for use in preserving a paint brush after it has been used. The holder includes a lid capable of tightly fitting a can, such as a fruit juice can or a quart or gallon oil can, which is customarily discarded in normal household practice. The lid has an opening capable of accommodating the handles of brushes of different sizes. Across the opening, there is freely supported a generally U-shaped spring capable of engaging the handle of a brush and holding the brush suspended from the lid in a paint solvent in the can. The opening around the brush is sealed by a tape penetrated by the handle. The brush is suspended with the lower ends of its bristles above the base of the can.

There is also disclosed apparatus for preserving a paint brush including a can with a paint solvent and an emulsifier, to aid in cleaning a brush for permanent or very long-time storage such as periods of many months or years, having a lid as disclosed above.

5 Claims, 2 Drawing Figures

PRESERVATION OF PAINT BRUSH

BACKGROUND OF THE INVENTION

This invention relates to the preservation of paint brushes, and has particular relationship to the preservation of paint brushes for future use after they have been used and the bristles are impregnated with paint.

Since good paint brushes are relatively costly, it is desirable that after a brush has been used, it be preserved in condition to be reused months or even years later. For appropriate preservation, it is necessary, not only that the bulk of the paint be removed from the bristles, but that the removal of paint be substantially complete. The cleaning of the last trace of paint from the bristles is a time-consuming, dirty, tedious and somewhat harmful task involving kneading, hand manipulating and scrubbing in solvents which are harmful to the skin and costly in the quantities demanded. Many, if not all, of the solvents used for this purpose evolve vapors of varying degree of toxicity which are impossible to void inhaling while working with these solvents. A thorough cleaning in soapy water is also recommended. However, this cleaning must take place immediately after the painting job, and the average user finds it disagreeable and difficult to expend the necessary energy at that time.

A common practice which is followed because its cost is low is to insert the brush in an open can of solvent with its bristles engaging the base of the can. The brush is left in this condition in the can until its next use. In this practice, when, as is usual, the interval between uses of the brush is relatively long, the solvent evaporates and the bristles of the brush become matted together to form a hard cake and are bent and a new brush is required.

In accordance with the teachings of the prior art, there are also brush keepers. However, these keepers are costly, and brushes of different sizes require different keepers. The common practice is to sacrifice the brushes rather than to buy keepers. Indeed there appears to be no economical and reliable facility for preserving paint brushes available, suitable for the average householder. Quoting *Modern Chemical Specialties*, Milton A. Lesser, MacNair Dorland Company, New York, 1950, "There are probably few articles purchased for the average householder in which there has been greater waste than in the case of paint brushes."

It is an object of this invention to overcome the disadvantages of the prior art, and to provide apparatus of low cost for preserving paint brushes which shall effectively clean and preserve the brushes, and shall accommodate in a single unit brushes of a wide range of sizes.

SUMMARY OF THE INVENTION

This invention arises from the realization that cans usually of tin-plated steel of various sizes which could accommodate brushes of many sizes and of generally standardized dimensions are available in households. Typical are fruit juice cans, coffee cans, oil cans and the like. It is customary that once the product in a can is consumed, the can is discarded. It has been realized that these cans can serve as paint-brush keepers.

In accordance with this invention, a tight-fitting lid, typically of plastic, is provided for these cans. This lid has an opening of dimensions capable of accommodating the handles of a wide range of sizes of brushes. The can selected for use with any lid is tall enough and of large enough diameter to enable the bristles of the brushes accommodated to be immersed in the solvent without engaging the base of the can. Means is provided for engaging and holding the handle of the brush firmly suspending the brush in the solvent. This means is advantgeously a spring which lies freely on the lid spanning the opening. Other means are magnets, velcro, a wire secured to a standard or the like. However, the freely disposed spring is to be preferred to this latter means because of its simplicity and low cost. The hole in the lid is sealed by Scotch tape or masking tape or any self-adhesive tape, through which the handle of the brush penetrates. The open region of the hold about the brush can also be stuffed with cotton, plastic foam or the like. It has been found that in an interval of 2½ months, an open can lost 156 grams of 336 grams of solvent, while a can sealed with tape in accordance with this invention lost only 9 grams of 336 grams of solvent.

BRIEF DESCRIPTION OF THE DRAWING

For a better understanding of this invention, both as to its organization and as to its method of operation, together with additional objects and advantages thereof, reference is made to the following description, taken in connection with the accompanying drawing, in which.

Figure 1:
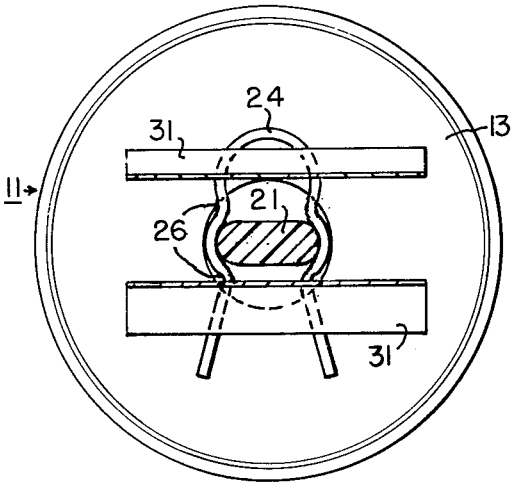
FIG. 1 is a plan view partly in section of a lid in accordance with the invention.
Figure 2:
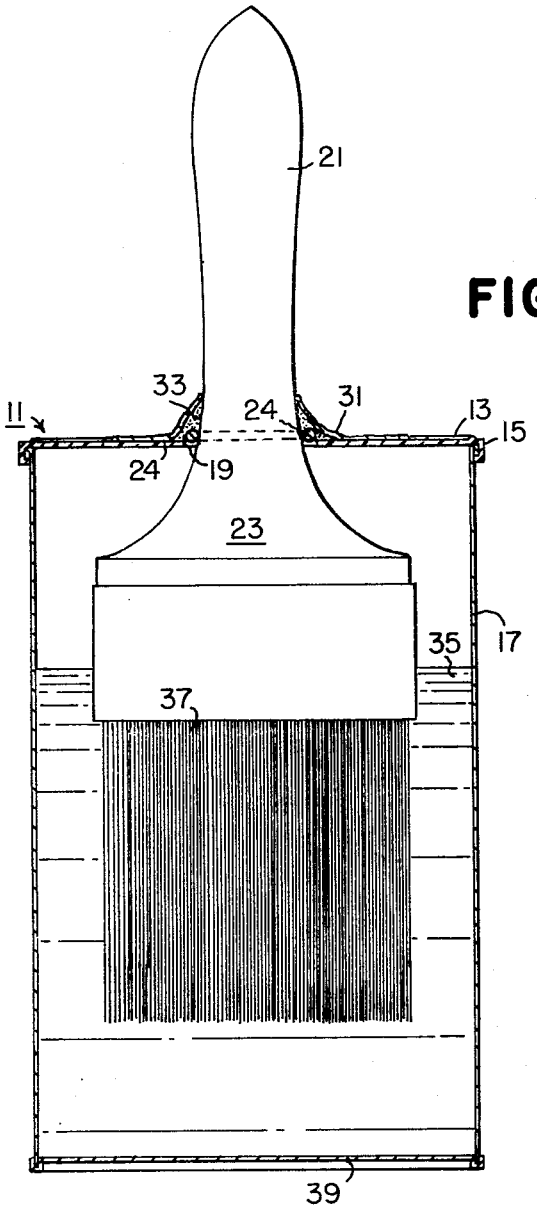
FIG. 2 is a view in longitudinal section showing preserving apparatus in accordance with the invention including a lid as shown in FIG. 1. cl DETAILED DESCRIPTION OF INVENTION The apparatus shown in the drawing includes a lid 11, typically of plastic, having a top 13 and a rim 15. The lid 11 is dimensioned to fit tightly over cans, such as the can 17, which contain consumable commodities and are customarily discarded when the commodity is consumed, with the rim 15 tightly hugging the upper rim of the can 17. Such cans 17 have generally standard dimensions so that a few lids 11 of limited different dimensions need be provided.

In the top 13 of the lid 11, there is an opening 19 capable of accomodating the handles of paint brushes of widely different dimensions. A handle 21 of a typical brush 23 extends through the opening 19. There is a region of the opening 19 around the handle 21 which is open. The brush 23 is held by a generally U-shaped spring or spring clip 24, which spans the opening 19 and lies freely on the top 13. The spring 24 has projections 26 in both arms; which are spaced from each other a short distance such that handles 21 of different size brushes 23 are firmly engaged and the brushes 23 firmly held. The spring, for suspending the brushes, should be of sufficient diameter or cross-sectional dimension, elastic strength and limit to provide for suspending the brush by its resiliency, but of low enough elastic limit to be deformable to fit brushes of somewhat smaller or larger dimensions than those for which the spring is initially set.

The opening 19 is sealed by an adhesive tape 31 which extends over the opening and the spring 24 and is penetrated by the handle 21. The adhesive 33 of the tape secures the tape 31 to the lid around the opening 19 and around the brush handle 21.

The can 17 contains a paint solvent or paint thinner or paint softener 35, such as turpentine or an aromatic hydrocarbon oil. Since the opening 19 in this lid is sealed to suppress escape of vapor, the solvent may also be a volatile and somewhat toxic material, such as benzol or methylene chloride. An emulsifier, such as the reaction products of monyl phenol and ethylene oxide may be added to the solvent.

Emulsifiers have been added to paint solvents, but the long time required for the emulsifier to be dissolved or incorporated in the thick paint on the bristles is a drawback to their efficient use. Manipulation of the brush in the emulsifier-solvent solution assists in the incorporation, but is difficult, unpleasant and to some unhealthy because of evolved vapors and skin penetration. The long contact time (without harmful side-effects such as evaporation, bristle bending) permitted by this invention allows sufficient time to get the full benefit of the usefulness of emulsifiers in cleaning paint brushes.

The same advantages apply to the use of the most efficient paint brush softeners for recovering hardened, ruined paint brushes as the most efficient solvents, such as methylene chloride, are usually very volatile, somewhat toxic and difficult and unpleasant to work with in the home.

A solid emulsifier (for economy in providing small packages to the householder) soluble in paint solvents may be used. An example of such an emulsifier in Nopalcol 4-S of the Diamond Shamrock Chemical Company and its chemical designation is polyethylene glycol 400 mono stearate.

The spring 24 holds the brush so that its bristles 37 are above the base 39 of the can 17. By the use of the lid 11 according to this invention and a can available in all households paint brushes can be preserved for long intervals at low cost. For the householder who uses many brushes or the professional painter, there are available, frequently used, suitable, larger cans such as the larger size coffee or fat cans which can be similarly used to hold several brushes at one time.

While an embodiment of this invention has been disclosed herein, many modifications thereof are feasible. This invention is not to be restricted except insofar as is necessitated by the spirit of the prior art.

I claim:

1. For use in preserving a paint brush while it is stored after it has been used, a paint brush holder including a lid tightly fitting a can which in customary household practice is discarded, said lid having an opening accommodating the handle of one of a number of brushes of the different sizes normally encountered, a spring engaging said handle of said brush and suspending said brush from the lid through said opening, said spring being of a dimension exceeding a cross-sectional dimension of said opening and being freely suspended over said opening on the surface of said cover, physically unattached to said cover, and adhesive tape adhered to the handle of said brush and to said cover sealing the portion of said opening about said handle.

2. The holder of claim 1 wherein the lid is a plastic lid.

3. The holder of claim 1 wherein the spring is of generally U-shape with its legs spaced, at least in a region thereof, a short distance so that the said brush is resiliently engaged and held near said region between said legs.

4. Apparatus for preserving a paint brush including a can which in customary household practice is discarded, a paint solvent within said can, a lid tightly fitting said can, said lid having an opening capable of accommodating the handles of brushes of different sizes, means supported by the portion of said lid bounding said opening for suspending a brush of said different sizes by its handle with the bristles of said brush extending into said solvent with their lower tips above the base of said can, said suspending means including a spring freely disposed on the surface of said lid physically unattached to said lid and resiliently engaging said handle and holding said brush in suspended position as aforesaid, and adhesive tape adhered to said handle and to said surface for sealing said opening about said handle.

5. The apparatus of claim 4 wherein the paint solvent includes an emulsifier.

* * * * *